US007264515B1

(12) United States Patent
Rubinstein

(10) Patent No.: US 7,264,515 B1
(45) Date of Patent: Sep. 4, 2007

(54) APPARATUS FOR ATTACHING ELECTRICALLY OPERATED DEVICES TO A DISPLAY PANEL

(75) Inventor: David B. Rubinstein, Boca Raton, FL (US)

(73) Assignee: Best Blinkers, Inc., Boca Raton, FL (US)

( * ) Notice: Subject to any disclaimer, the term of this patent is extended or adjusted under 35 U.S.C. 154(b) by 60 days.

(21) Appl. No.: 11/125,798

(22) Filed: May 10, 2005

(51) Int. Cl.
*H01R 24/00* (2006.01)

(52) U.S. Cl. ..... 439/664; 211/85.2; 362/104; 439/700

(58) Field of Classification Search ..... 362/104; 439/675, 578, 700, 824, 339, 340, 664, 668; 211/85.2
See application file for complete search history.

(56) References Cited

U.S. PATENT DOCUMENTS 1,171,851 A * 2/1916 Klein ..... 439/664
1,373,299 A * 3/1921 Byrne ..... 40/541
1,977,378 A * 10/1934 Doane ..... 439/339
2,465,517 A * 3/1949 Danner ..... 439/664
3,997,050 A * 12/1976 Patterson ..... 206/566
4,035,630 A 7/1977 Burke
4,076,976 A 2/1978 Fenton
4,408,261 A 10/1983 Polakof
4,459,645 A * 7/1984 Glatter ..... 362/104
5,067,906 A * 11/1991 Woodgate ..... 439/115
5,876,109 A * 3/1999 Scalco ..... 362/104
5,934,784 A 8/1999 Dion
5,957,717 A * 9/1999 Monsef et al. ..... 439/339
6,533,435 B2 3/2003 Brown
7,110,762 B1 * 9/2006 Cameron et al. ..... 455/434

FOREIGN PATENT DOCUMENTS

EP 0588279 A3 12/1994

* cited by examiner

*Primary Examiner*—Neil Abrams
(74) *Attorney, Agent, or Firm*—Ronald V. Davidge

(57) ABSTRACT

A display unit includes a number of connectors for attaching and powering electrically powered devices, such as illuminated jewelry items, each including a battery and an end cap which is removed when the item is placed on the display connector. Each of the connectors includes a threaded mounting surface engaging a threaded mounting surface of one of the devices. The orientation of each device is adjusted by its rotation in engagement with the connector as a resiliently mounted electrical contact surface of the connector is held in contact with a contact surface of the device so that electrical power is retained within the device.

6 Claims, 2 Drawing Sheets

APPARATUS FOR ATTACHING ELECTRICALLY OPERATED DEVICES TO A DISPLAY PANEL

BACKGROUND OF THE INVENTION

1. Field of the Invention

This invention relates to the attachment of one or more electrically operated devices to a display panel, more particularly, to a connector attaching one of such devices to provide electrical power to the device in a manner allowing for adjustment of the orientation of the device on the panel, and additionally to apparatus for displaying electrically illuminated jewelry.

2. Summary of the Background Art

The patent literature includes a number of descriptions of jewelry items including LEDs (light emitting diodes) illuminated by one or more miniature batteries held within the jewelry items or attached thereto. For example, U.S. Pat. No. 4,035,630 describes a decorative article for wearing on clothing, having LEDs that alternately flash on and off. U.S. Pat. No. 4,076,976 describes an assembly including a battery and a pair of connectors that causes an LED mounted on a piece of jewelry to emit a flashing light when a pair of pins extending from the jewelry is pressed into the connectors. U.S. Pat. No. 4,408,261 describes a charm carrying a battery operated light that may be turned on and off. U.S. Pat. No. 5,934,784 describes an intermittently illuminated article of apparel that includes a light source and a flasher connected to the light source. U.S. Pat. No. 6,533,435 describes a small portable light including a battery and a flexible wire that can be twisted around a terminal to energize an LED.

FIG. 1 is a fragmentary longitudinal cross-sectional view of a currently available electrically operated jewelry item 10, which is understood to be a device to be worn for display or ornamental purposes. The jewelry item 10 includes a placard 12, which is visible outwardly when the jewelry item 10 is worn, and a battery housing 14, which extends in the rearward direction of arrow 16 from the placard 12. The placard 12 includes a number of LEDs 18, each visible through a window 20 in a front surface 22, that are flashed on and off by a circuit (not shown) within the placard 12 electrically connected to a pair of batteries 24, such as CR927 round batteries, within the battery housing 14. The batteries 24 are held within the battery housing 14 by means of a battery cap 26. The jewelry item 10 further includes an internal magnet 28 and an external magnet 30, which together hold the jewelry item 10 in place when it is worn with a clothing layer, such as a shirt pocket or collar disposed between the rear surface 32 of the battery cap 26 and the external magnet 30.

The battery cap 26 is removably attached to the battery housing 14 by means of external threads 34 of the battery cap 26 engaging a threaded mounting surface 36 of the battery housing 14. Electrical power to the circuit within the placard 12 is provided from an outer surface 38 of the batteries 24 through the conductive inner magnet 28, through the conductive battery cap 26 and through the conductive battery housing 14, with an inner surface 40 of the batteries 24 being held against a central contact surface 42 of the placard 12. The central contact surface 42 is disposed coaxially with the threaded mounting surface 36 of the battery housing 14. When the inner surface 40 of the batteries 24 is held away from the central contact surface 42, as it is in the example of FIG. 1, electrical current does not flow from the batteries 24 into the circuit within the placard 12 to illuminate the LEDs 18, which are then turned on by turning the battery cap 26 as a knob to bring the inner surface 40 into contact with the central contact surface 42. A nonconductive resilient ring 44 may be additionally installed between the batteries 24 and the placard 12 to hold the inner surface 40 out of contact with the central contact surface 42 when the battery cap 26 has not been screwed inward to turn the LEDs 18 on.

While the jewelry item 10 is being worn on a user's clothing, the batteries 24 provide sufficient power to illuminate low-power devices, such as the LEDs 18. However, it is additionally desirable to provide a display unit in which one or more of the jewelry items 10 may be displayed for sale, with the LEDs 18 being illuminated with power from an external source, so that the LEDs can remain on and flashing for extended periods within a store displaying the jewelry items 10 for sale.

Connectors have been devised and used for attaching and powering devices having internally threaded housings and contact surfaces coaxial with the internal housing threads. For example, European Patent Application 0588279A3 describes a cylindrical battery having a retaining and mounting device in the form of an externally threaded cylinder with a contact terminal disposed at an external end of the externally threaded cylinder. However, when a display panel including a number of connectors of this kind is used for the attachment of the jewelry item 10, it becomes apparent that, when the jewelry item 10 is rotated into a position on the connector in which power is provided through the connector to the jewelry item 10, the placard 12 is disposed at a random angle that cannot be adequately adjusted without turning off electrical power to the jewelry item 10. In general, the placard 12 includes indicia, in the form of printed markings, an external shape, and/or the placement of the LEDs 18, providing a preferred orientation of the jewelry item 10 on a display unit. Therefore, what is needed is a connector for mounting an electrically powered device having a threaded mounting surface, such as the jewelry item 10, in a preferred orientation, with power being supplied to the electrically powered device through the connector.

SUMMARY OF THE INVENTION

In accordance with a first aspect of the invention, a connector, including a housing and an electrical contact surface, is provided for mounting an electrically operated device having a threaded mounting surface to be disposed in a preferred orientation. The housing has a cylindrical mounting surface extending outward around an axis, with the cylindrical mounting surface in turn including threads for engaging the threaded mounting surface of the electrically operated device. The threads of the cylindrical mounting surface are configured to move the electrically operated device along the axis of the cylindrical mounting surface through a first distance with each revolution of the electrically operated device around the axis of the cylindrical mounting surface in engagement with the threads of the cylindrical mounting surface. The electrical contact surface, which is coaxially disposed with the threaded and electrically conductive cylindrical surface, is resiliently mounted to be held outward and to move inward along the axis of the cylindrical mounting surface through an engagement distance exceeding the first distance.

The electrical contact surface may be formed at an end of a probe mounted to slide against a compression spring within a probe mounting cylinder forming a part of the connector, with a first wire attached to the housing and with a second wire attached to the probe mounting cylinder.

One or more such connectors may be provided within display apparatus additionally including a display panel to which the connectors are attached and a power supply, with the first wire from each connector being electrically connected to a first terminal of the power supply and with the second wire from each connector being electrically connected to a second terminal of the power supply. One or more electrically operated devices may be included with such display apparatus, with an orientation of each of the electrically operated devices being adjusted by rotating the electrically operated device with a threaded mounting surface of the electrically operated device engaged by the threads of the cylindrical mounting surface of a connector, and with the contact surface of the connector remaining in engagement with a contact surface of the electrically operated device.

DETAILED DESCRIPTION OF THE INVENTION

Figure 1:
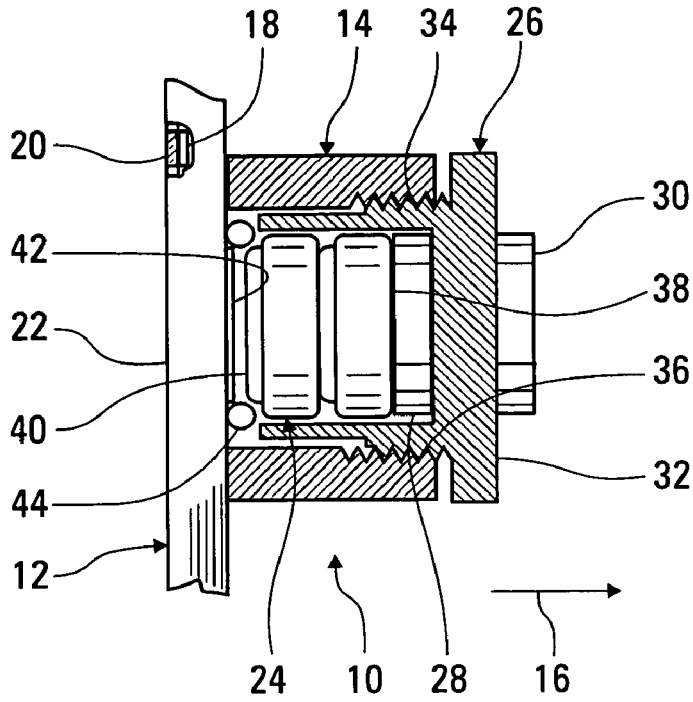
FIG. 1 PRIOR ART
FIG. 1 is a fragmentary longitudinal cross-sectional view of a currently available electrically operated device in the form of a jewelry item.
Figure 2:
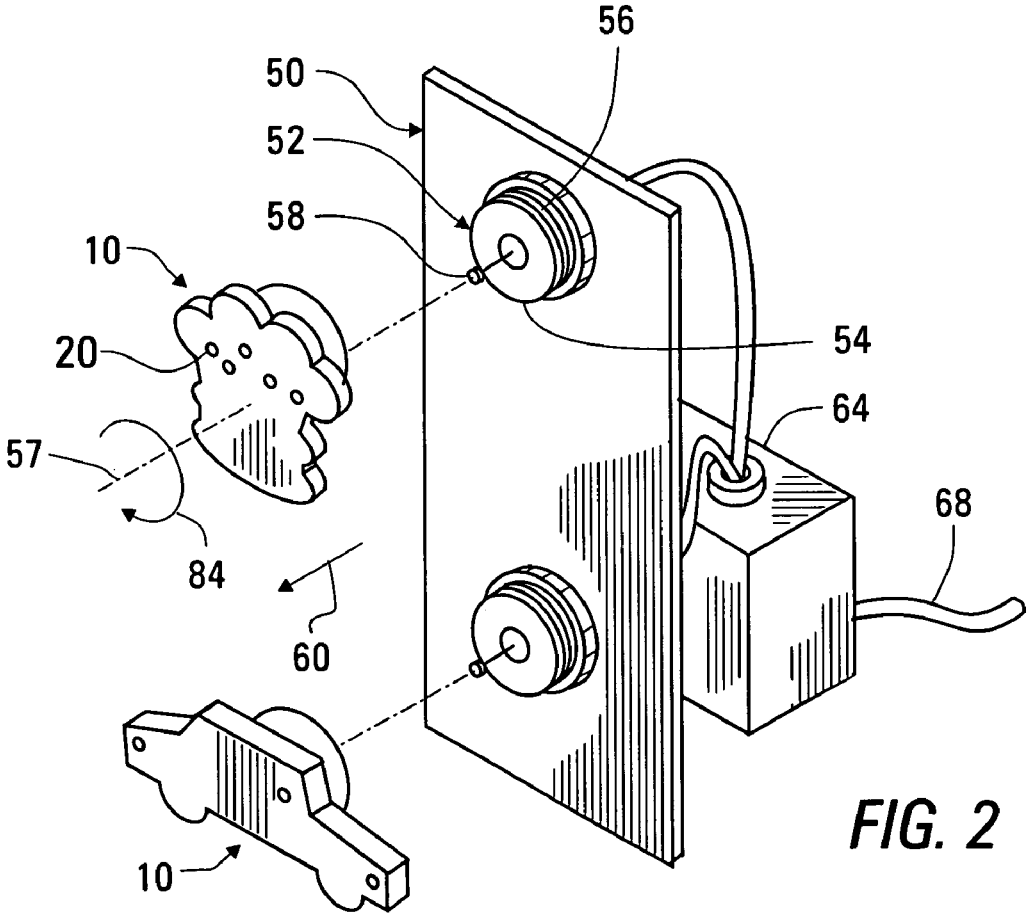
FIG. 2 is a perspective view of a display panel built in accordance with the invention to hold a number of the devices of FIG. 1, which are shown in an exploded relationship with the display panel.

FIG. 2 is a perspective view of a display panel 50 built in accordance with the invention to hold a number of the electrically operated devices 10, an example of which, in the form of a jewelry item, has been explained above in reference to FIG. 1. Each of the devices 10, which are shown in an exploded relationship with the display panel 50, includes a placard 12 including windows 20 through which LEDs flash, with electrical power being provided through a connector 52 attached to the display panel 50. The connector 52 includes a housing 54 having a cylindrical mounting surface 56 extending around an axis 57 for engaging the threaded mounting surface 36 (shown in FIG. 1) of one of the electrically operated devices 10. The connector 52 additionally includes an electrical contact surface 58, extending outward from the housing 54, in the direction of arrow 60.

Figure 3:
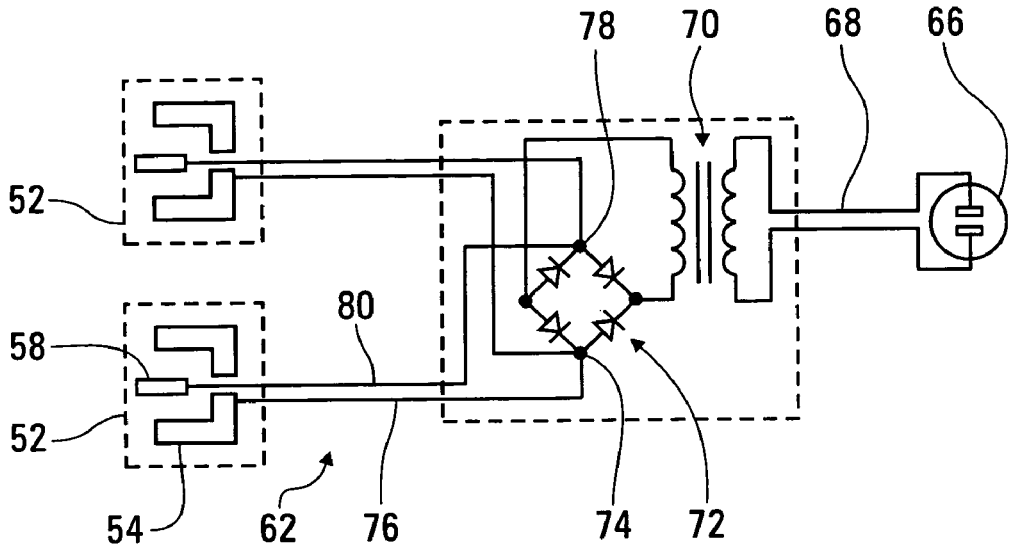
FIG. 3 is an electrical schematic view of the a display device including the display panel of FIG. 2.

FIG. 3 is an electrical schematic view of a display device 62 including the display panel 50 of FIG. 2. The display device 62 includes a power supply 64 converting a line voltage provided as an input through a plug 66 in a line cord 68 to a DC voltage suitable for driving the circuits within the electrically operated devices 10. For example, the power supply 64 includes a transformer 70 and a rectifier 72. The power supply 64 may further include additional elements, such as filters and voltage regulation circuits, well known to those skilled in the art of power supply design. The housing 54 within each of the connectors 52 is electrically connected to a first output terminal 74 of the power supply 64 by a first wire 76. The electrical contact surface 58 of each of the connectors 52 is electrically connected to a second output terminal 78 of the power supply 64 by a second wire 80.

Figure 4:
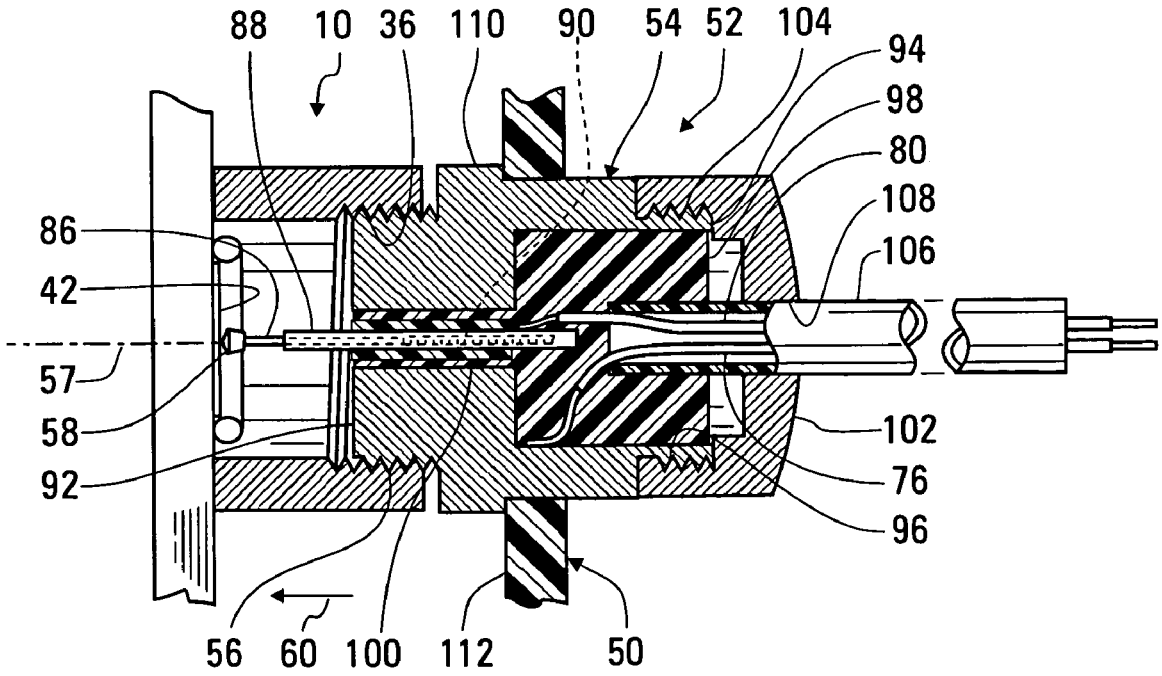
FIG. 4 is a fragmentary cross-sectional elevation of the display device of FIG. 3, showing the electrically operated device of FIG. 1 installed on a connector within the display panel of FIG. 2.

FIG. 4 is a fragmentary cross-sectional elevation of the display device 63, showing one of the electrically operated devices 10 installed on one of the connectors 52 mounted in the display panel 50.

Before the electrically operated device 10 is installed on the connector 52, various elements of the device 10, as described above in reference to FIG. 1, are removed. These removed elements include the batteries 24, the magnets 28, 30, and the battery cap 26. The electrically operated device 10 is then installed on one of the connectors 52 by rotating the device 10 in the direction of arrow 84 (shown in FIG. 2) about the axis 57 of the cylindrical mounting surface 56 of the connector 52, with the threads of the threaded mounting surface 36 of the device 10 in engagement with the threads of the cylindrical mounting surface 56 of the connector 52.

The electrical contact surface 58 of the connector 52 is disposed at an outer end of a probe 86, which is mounted to slide in the outward direction of arrow 60 and opposite thereto, in a probe mounting cylinder 88. The probe 86 is held against an outer end of a compression spring 90 within the probe mounting cylinder 88. In this way, the electrical contact surface 58 is slidably mounted to be held outward from the front end 92 of the housing 54 by the compression spring 90 and to move inward, opposite the direction of arrow 60, along the axis 57 of the cylindrical mounting surface 56. Features within the probe mounting cylinder 88 limit the outward movement of the probe 86 to movement through an engagement distance, so that the probe 86 is not ejected from the probe mounting cylinder 88 when the device 10 is removed from the connector 52.

The mating threaded surfaces 36, 56 of the device 10 and the connector 52 are configured so that the device 10 is moved through a first distance, in or opposite the direction of arrow 60, for each revolution of the device 10 in or opposite the direction of arrow 84 with the threaded surfaces 35, 56 in engagement with one another. For example, if the threads of the surfaces 36, 56 are single pitch, the first distance is equal to the pitch distance between adjacent threads on either of the surfaces 36, 56. In accordance with the invention, the engagement distance, through which the electrical contact surface 58 can be moved, is greater than the first distance, through which the device 10 is moved along the axis 57. In this way, movement of the device 10 through the engagement distance can always be used to rotate the device 10, in or opposite the direction of arrow 84, to align the device 10 in a preferred orientation, with the contact surface 58 remaining in contact with the central contact surface 42 of the device 10 to assure continued electrical operation of the device 10.

The rear end 94 of the housing 54, which is disposed opposite the front end 92 thereof, includes a cavity 96. The first wire 76 is soldered to a surface of the cavity 96, while the second wire 80 is soldered to an outer surface of the probe mounting cylinder 88 within the cavity 96. In this way, an electrical connection is made between the second wire 80 and the electrical contact surface 58 through the conductive probe mounting cylinder 88, the compression spring 90, and the probe 86. Preferably, the cavity 96 is filled with a polymeric resin 98 after the attachment of the wires 76, 80 to the surface of the cavity 96 and to the probe mounting cylinder 88, respectively, to hold the wires 76, 80 and the probe mounting cylinder 88 in place. An insulating tube 100 may also be installed around the probe mounting cylinder 88 to ensure that electrical contact does not occur between this cylinder 88 and the housing 54. Preferably, the connector 54 additionally includes a cap 102, which is screwed onto the rear end 94 of the housing 54 at a threaded connection 104 to cover the cavity 96. The wires 76, 80 extend rearward, opposite the direction of arrow 60 from the cavity 96 within a tubular cover 106 through a hole 108 within the cap 96.

Conventional means are used to attach each of the connectors 52 to the panel 50, for example, the connector 52 may be pressed into the panel 50 until a flange 110 of the connector rests against a surface 112 of the panel 50. Alternately, an adhesive may be used to hold the connector 52 in place within the panel 50, or an additional clamping nut engaging an outer threaded surface (not shown) of the housing 57 may be used. There is no need to adjust the rotational position of the connector 52 within the panel 50, since each of the electrically operated devices 10 may be adjusted by rotation in or opposite the direction of arrow 84 with the contact surface 58 remaining in contact with the central contact surface 42 in accordance with the invention, so that the device 10 is held at a preferred orientation determined by the indicia, shape, and lighted windows 20 of the placard 12 of the device 10.

While the invention has been described in terms of a preferred embodiment with some degree of particularity, it is understood that this description has been given only by way of example, and that many variations in the arrangement of parts may be achieved without departing from the spirit and scope of the invention, as defined within the appended claims.

What is claimed is:

1. Apparatus comprising at least one electrically operated device comprising a jewelry item including a light emitting diode and having a threaded mounting surface and a central contact surface coaxial with the threaded mounting surface, a power supply having first and second output terminals, a display panel, and at least one connector attached to the display panel, wherein each of the at least one connector includes:

a housing including a cylindrical mounting surface extending outward around an axis, including threads for engaging the threaded mounting surface of the electrically operated device, wherein the threads of the cylindrical mounting surface are configured to move the electrically operated device along the axis of the cylindrical mounting surface through a first distance with each revolution of the electrically operated device around the axis of the cylindrical mounting surface in engagement with the threads of the cylindrical mounting surface;

an electrical contact surface, coaxially disposed with the threaded and electrically conductive cylindrical surface and resiliently mounted to be held outward and to move inward along the axis of the cylindrical mounting surface through an engagement distance exceeding the first distance;

a first wire electrically connected to the housing and to the first output terminal of the power supply; and a second wire electrically connected to the electrical contact surface and to the second output terminal of the power supply, and an orientation of each of the at least one electrically operated device is adjusted by rotating the electrically operated device with the threaded mounting surface of the electrically operated device engaged by the threads of the cylindrical mounting surface of the connector and with the central contact surface of the electrically operated device engaging the electrical contact surface of the connector.

2. The apparatus of claim 1, additionally comprising a probe mounting cylinder, a compression spring disposed within the probe mounting cylinder, and a probe mounted to slide within the probe mounting cylinder against an outer end of the compression spring and to extend outward from an outer end of the probe mounting cylinder, wherein the electrical contact surface is disposed at an outer end of the probe.

3. The apparatus of claim 1, additionally comprising a first wire attached to the housing and a second wire attached to the probe mounting cylinder.

4. The apparatus of claim 3, wherein the electrical contact surface extends outward from a front end of the housing, a rear end of the housing, opposite the front end of the housing, includes a cavity, the wires are attached to the housing and to the probe mounting cylinder within the cavity to extend rearward from the housing, and the cavity is filled with a polymeric resin.

5. The apparatus of claim 4, additionally comprising a cap covering the cavity and having a central hole, wherein the wires extend rearward within a tubular cover through the central hole.

6. The apparatus of claim 1, wherein the cylindrical mounting surface forms a portion of an external surface of the housing, and the threaded mounting surface of the electrically operated device extends along a surface of a cavity within the electrically operated device.

* * * * *